US011596854B2

(12) United States Patent
Williams

(10) Patent No.: US 11,596,854 B2
(45) Date of Patent: Mar. 7, 2023

(54) TRACTIVE ELEMENTS AND PATTERNS FOR THE RUNNING SURFACE OF A SKI BOTTOM IN FIXED AND REMOVABLE CONFIGURATIONS

(71) Applicant: Bruce P Williams, Grosse Pointe Park, MI (US)

(72) Inventor: Bruce P Williams, Grosse Pointe Park, MI (US)

(73) Assignee: Bruce P. Williams, Grosse Pointe Park, MI (US)

( * ) Notice: Subject to any disclaimer, the term of this patent is extended or adjusted under 35 U.S.C. 154(b) by 0 days.

(21) Appl. No.: 17/239,618

(22) Filed: Apr. 25, 2021

(65) Prior Publication Data

US 2022/0339524 A1 Oct. 27, 2022

(51) Int. Cl.
*A63C 7/00* (2006.01)
*A63C 5/12* (2006.01)

(52) U.S. Cl.
CPC ..... *A63C 7/005* (2013.01); *A63C 5/12* (2013.01)

(58) Field of Classification Search
CPC ..... A63C 7/005; A63C 5/12; A63C 7/00; A63C 7/02
See application file for complete search history.

(56) References Cited

U.S. PATENT DOCUMENTS 4,440,418 A * 4/1984 Staufer ..... A63C 5/044 280/610
4,714,266 A * 12/1987 Feichtlbauer ..... A63C 7/06 280/604
7,758,061 B2 * 7/2010 Staudinger ..... A63C 7/06 280/608
8,317,217 B2 * 11/2012 Zemp ..... A63C 7/02 280/809
10,315,098 B2 * 6/2019 Nobil ..... A63C 7/06
2010/0239808 A1 * 9/2010 Schwitter ..... A63C 7/02 425/88
2011/0193322 A1 * 8/2011 Holzer ..... A63C 5/0428 280/609
2013/0134691 A1 * 5/2013 Holzer ..... A63C 5/0405 280/604

(Continued)

FOREIGN PATENT DOCUMENTS

DE 1954075 A1 * 10/1969
JP H01178185 U * 12/1989

(Continued)

*Primary Examiner* — James A Shriver, II
*Assistant Examiner* — Michael T. Walsh
(74) *Attorney, Agent, or Firm* — Caldwell Intellectual Property Law

(57) ABSTRACT

Embodiments relate to a denticle scale array including a plurality of denticle scales arranged in pattern and configured to be incorporated onto a ski base, wherein the plurality of denticle scales includes at least a denticle scale including a glide contact area configured to contact terrain when the ski base is unweighted and moving forward, a kick contact area greater than the glide contact area and configured to contact the terrain when the ski base is weighted and not moving forward, at least a longitudinal profile comprising an S-curve, a curved trailing edge profile, and at least a longitudinal groove running parallel with the forward movement of the ski base.

20 Claims, 10 Drawing Sheets

5B

(56) References Cited

U.S. PATENT DOCUMENTS

| | | | | |
|---|---|---|---|---|
| 2016/0045813 | A1* | 2/2016 | Mayrhofer | A63C 7/02<br>156/60 |
| 2017/0120136 | A1* | 5/2017 | Shute | A63C 7/04 |
| 2020/0086201 | A1* | 3/2020 | Daniell | A63C 7/1086 |

FOREIGN PATENT DOCUMENTS

| | | | | |
|---|---|---|---|---|
| WO | WO-9324192 | A1 * | 12/1993 | A63C 7/06 |
| WO | WO-2007003014 | A1 * | 1/2007 | A63C 7/08 |
| WO | WO-2014146159 | A1 * | 9/2014 | A63C 5/12 |

* cited by examiner

5A

5B

TRACTIVE ELEMENTS AND PATTERNS FOR THE RUNNING SURFACE OF A SKI BOTTOM IN FIXED AND REMOVABLE CONFIGURATIONS

RELATED APPLICATION

This application claims priority to U.S. provisional patent application No. 63/015,583 entitled "Tractive Elements and Patterns for the Running Surface of a Ski Bottom in Fixed and Removable Configurations" filed Apr. 26, 2020, the contents of which provisional application are incorporated herein by reference in their entirety.

BACKGROUND

Solutions that enable uphill and forward traction when applied to the bottom of skis have existed for some time. For the snow sports of cross-country skiing and backcountry skiing, having a ski that has the ability to provide forward and/or uphill movement with input from the skier is essential. Many solutions, both fixed to the ski bottom and removable from the ski bottom, have been employed over the years to provide the means for forward or uphill movement on the bottom surface of skis. The solutions employed for forward and uphill movement on the bottom of skis have commonly been of two categories—wedge shaped 'scales' patterned in the bottom ski surface, or a plush fabric of short mohair or nylon hairs added to the bottom of the ski surface. Again these solutions can be fixed to the ski bottom or removable—as in a ski climbing skin. Since forward or uphill movement on skis requires physical effort from the skier, the most efficient solution is highly desired. Therefore, a solution for forward and uphill traction that is unique and novel in approach and has efficiency benefits over existing designs would be useful to participants of snow sports activities that include forward and uphill movement on skis. Solutions for tractive uphill/forward movement on skis that are 1. fixed to the ski and 2. removable from the ski are both applicable and desirable.

Biomimicry, the design of products, materials and systems that are inspired by nature, can provide a unique point of view with which to develop a tractive forward/uphill ski bottom for snow sports. As an example, the denticles that make up the skin of sharks have been a source of inspiration for many products that look to reduce aerodynamic drag. These shark skin denticles have a uniquely detailed surface structure which can be used as a point of general reference for functionally unique design solutions. In fact, it is known that shark skin denticles also have a grain structure, where there is a low amount of surface resistance when traveling 'with' the grain, and a significantly higher amount of surface resistance when traveling 'against' the grain. This dual function of low resistance in one direction, combined with a higher resistance in the opposing direction, can be a source of inspiration in the development of a unique and novel solution to forward/uphill movement in snow sports using a tractive ski bottom. The surfaces that make up each individual sharkskin denticle are very complex and allow for optimal packaging when composed as a multi denticle array, or sheet.

Accordingly, there is a desire for the participants of particular snow sports, which have forward or uphill movement on skis, to have the most efficient tractive solution on the ski bottom in order to minimize human energy input—and thus not tire as easily. This can be accomplished through a unique and novel approach to the ski bottom surface that incorporates an array like structure of denticles, or 'scales', which minimizes the resistance of the ski bottom to forward or uphill motion, and maximizes the resistance of the ski in the reverse direction.

DETAILED DESCRIPTION

Disclosed herein is a unique denticle scale that can be used in a sheet array configuration when applied to the bottom of a ski used in snow sports, where said denticle scales aid in forward/uphill motion when skiing. The denticle scale sheet array can be fixed to the bottom of the ski, or the denticle sheet array can be removable, as in a ski climbing skin. The denticle scale sheet array can be made of molded plastic such as polyethylene, or another suitable plastic tor material that is robust and appropriate for use in snow sports. The denticle scale sheet can also be integrated with other materials that contribute to the forward/uphill traction.

The characteristics of the individual denticles scales are unique and novel, and the shape of the denticle scales enables a number of useful performance features.

Figure 4:
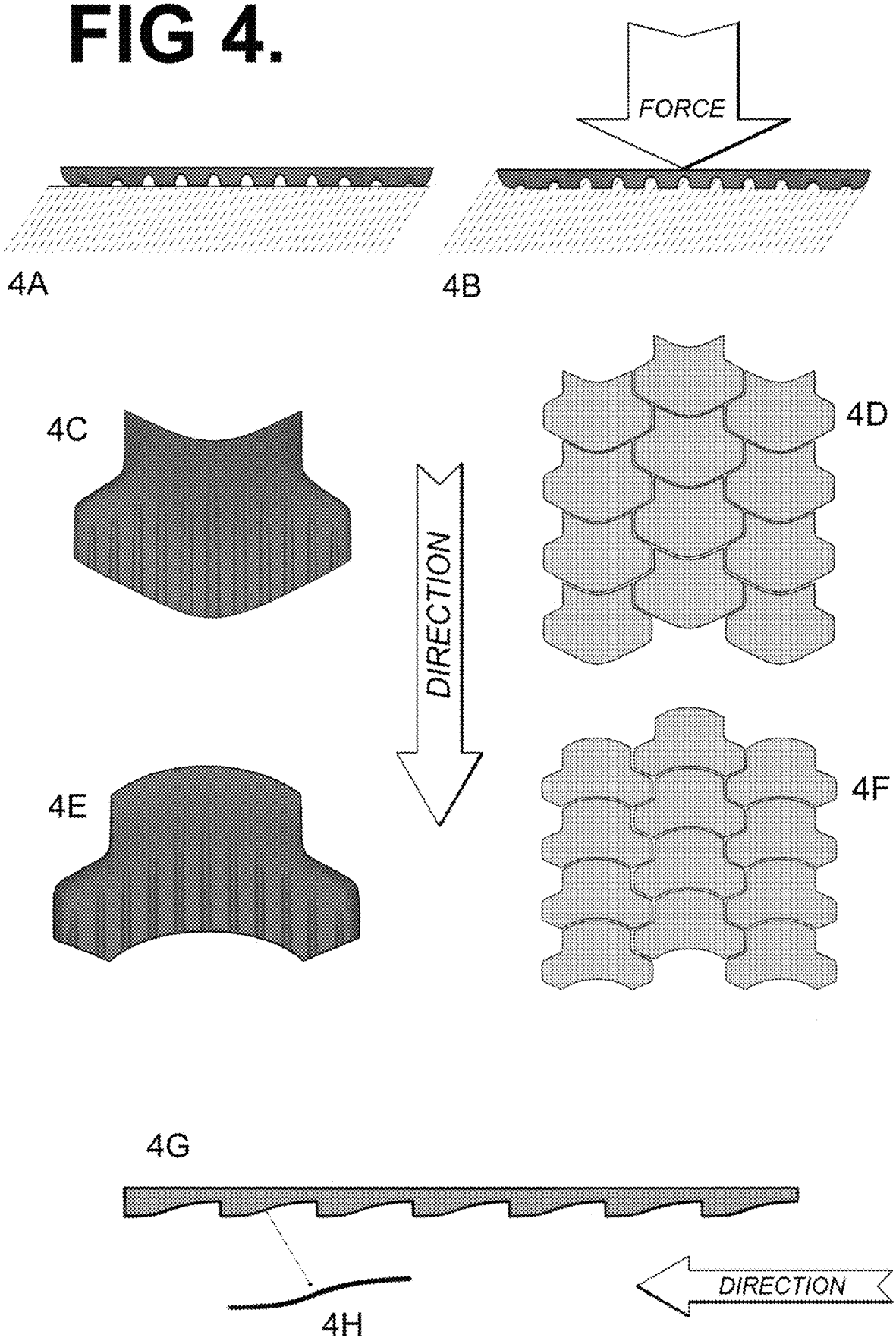
FIG. 4 shows multiple views of the denticle scale tiles that detail the unique functionality of the denticle scale surface geometry.

First, the individual denticle scales have a minimized footprint, or contact area, when in glide mode. The footprint or contact area is defined here as the interface area between the denticle scales and the surfaces adjacent to the denticle scales—examples being snow and ice terrain. Glide mode can be described as the forward movement of the ski, equipped with denticle scales on the ski bottom, in an unweighted condition. Conversely, the individual denticle scales have a maximized footprint, or contact area, when in kick mode. Kick mode can be described as a momentary static position of the ski, equipped with denticle scales on the ski bottom, in a weighted condition. This is shown in FIG. 4 rear view 4A, 4B.

Second, the individual scales have a front to back section profile with characteristics of an OG curve line, defined as a double curve resembling an 'S'—formed by the union of a convex and a concave line. The OG curve section profile of the individual denticle scales permits minimized resistance to forward motion when employed on a ski bottom, thus aiding in the efficiency in forward movement for the skier. This is shown in FIG. 4 side view 4G, 4H.

Third, the individual denticle scales have a trailing edge profile, or profiles, that permit traction from multiple angles. The trailing edge profile(s) provide traction directly in line with forward motion input from the skier, and additionally can provided traction at angles relative to forward motion skier input. These unique trailing edge profile(s) can aid the skier by providing traction at multiple angles and on varied topographical terrain. It should be noted that for those skilled in the art, there are multiple surface solutions to the individual denticle scale that can maximize the amount of rear tractive surface, as done in the unique and novel way as described herein. This is shown in FIG. 4 top view 4C, 4B.

Fourth, the individual denticle scales can be arranged in an array format containing multiple scales. The denticle scales in array format are arranged in such a way that the trailing edges of the denticle scales have the ability to overlap, when viewing the denticle scale array in rear view. The ability to arrange the denticle scales in such a manner creates a maximal amount of tractive surface in a unique arrangement, thus increasing the uphill movement capability of the skier employing a unique and novel tractive scale pattern on the skis being used. It should be noted that for those skilled in the art, there are multiple surface solutions to denticle scale array patterns that can maximize the amount of rear tractive surface, as done in the unique and novel way described herein. This is shown in FIG. 4 top view 4D, 4F.

Fifth, the individual denticle scales, as well as the denticle scales arranged in an array configuration have unique surface geometry such that they can be molded in a conventional manner in plastic or other appropriate material. This feature allows for fabrication of the denticle scales (individual, array) in a simple and cost effective manner.

Figure 1:
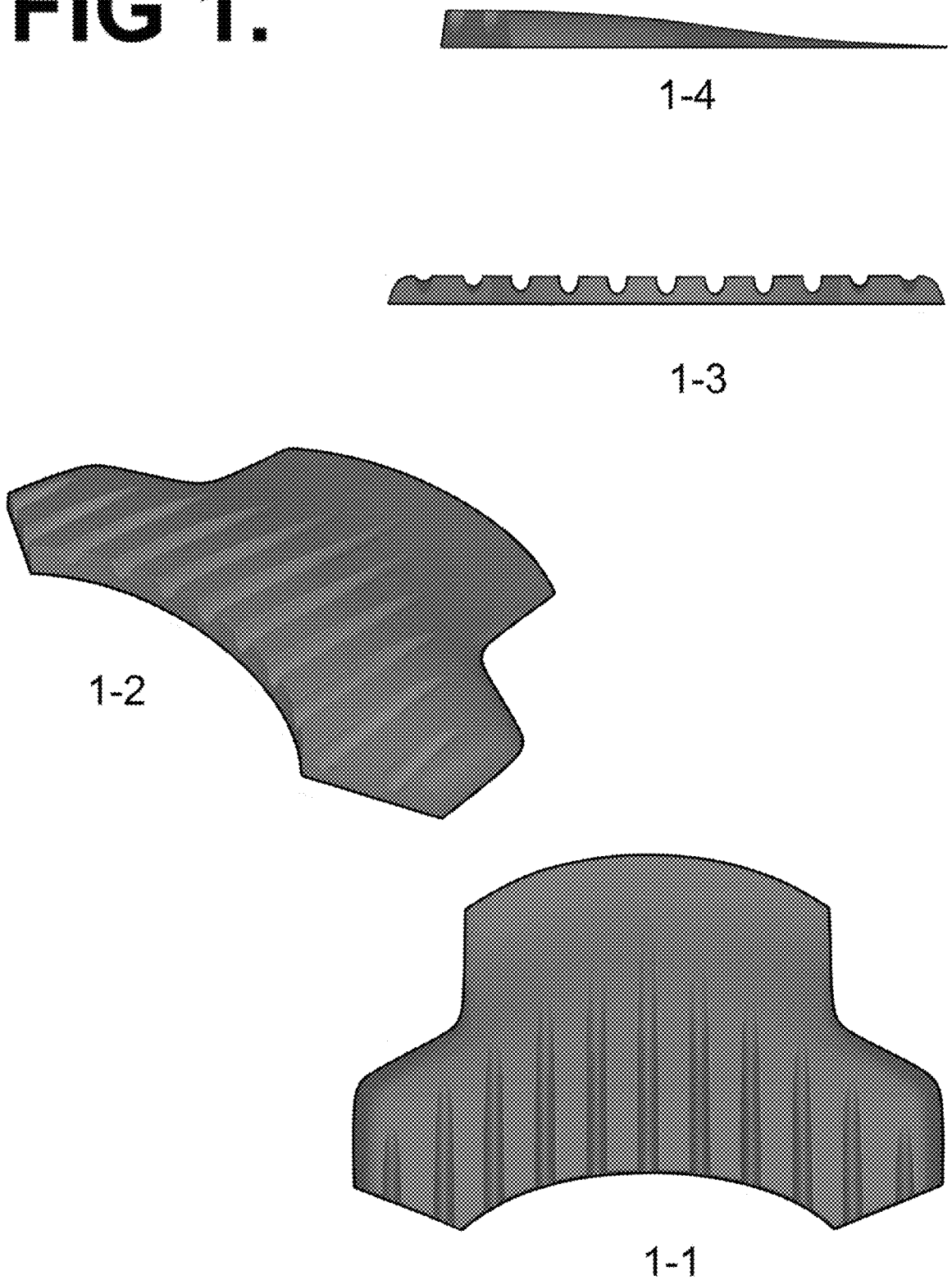
FIG. 1 shows multiple views (top 1-1; perspective 1-2; rear 1-3; side 1-4) of an individual tractive scale design. Surface geometry is shown in detail in all views.

Referring to FIG. 1, a tractive individual denticle scale is shown in multiple views, and is described as Concept #1. Top view 1-1 shows the surface detail and perimeter of an individual denticle scale. Perspective view 1-2 shows the surface detail of indented grooved surfaces that are located on an individual denticle scale. Rear view 1-3 shows the raised surface of the individual denticle scale that is intersected with the snow surface during the tractive and glide phases of forward/uphill motion on a ski bottom. Side view 1-4 shows the OG curve profile of an individual denticle scale—the OG curve profile defined as a double curve resembling an 'S', formed by the union of a convex and concave line.

Figure 2:
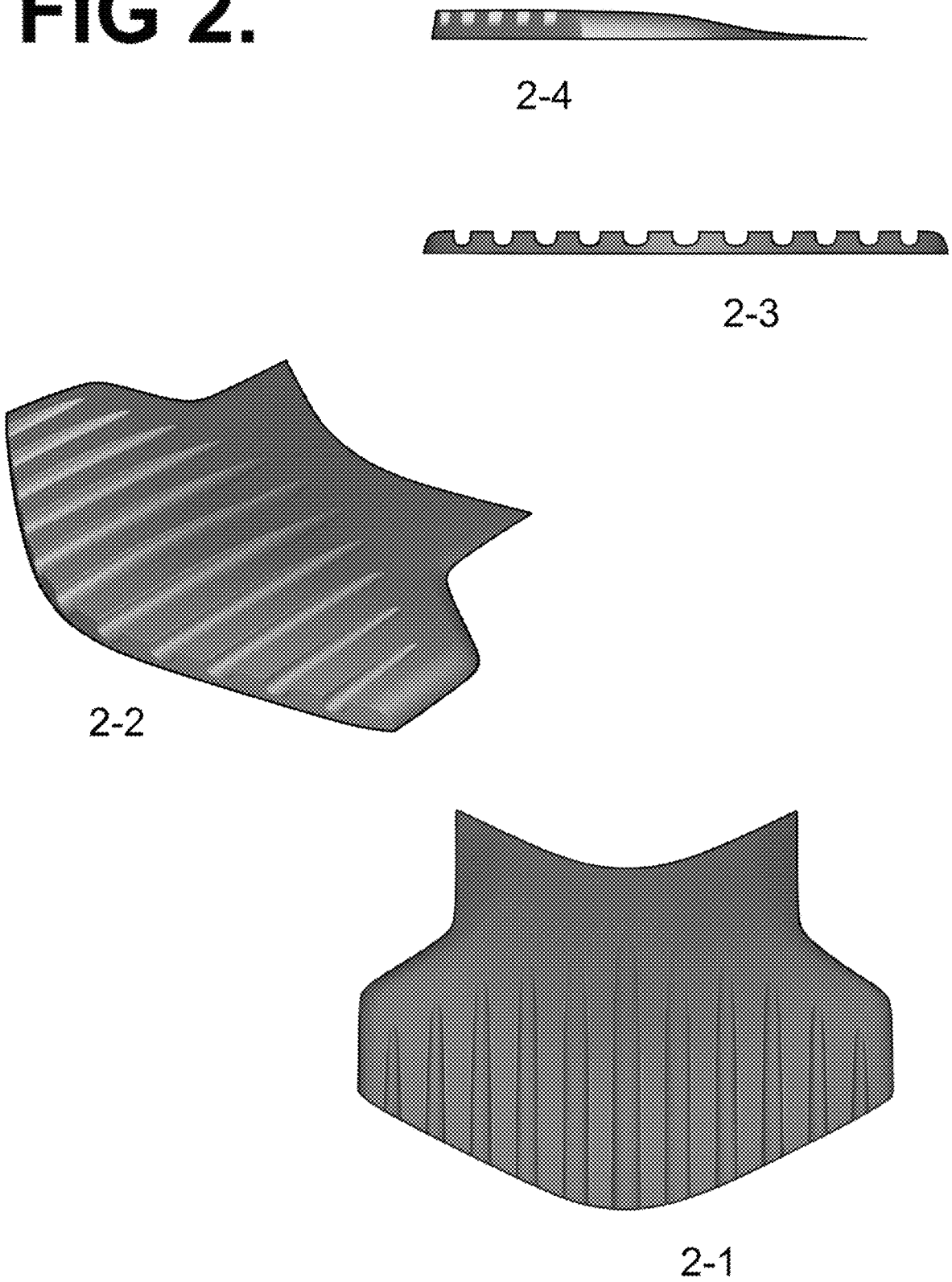
FIG. 2 shows multiple views (top 2-1; perspective 2-2; rear 2-3; side 2-4) of an individual tractive scale design. Surface geometry is shown in detail in all views.

Referring to FIG. 2, a tractive individual denticle scale is shown in multiple views. Top view 2-1 shows the surface detail and perimeter of an individual denticle scale. Perspective view 2-2 shows the surface detail of indented grooved surfaces that are located on an individual denticle scale. Rear view 2-3 shows the raised surface of the individual denticle scale that is intersected with the snow surface during the tractive and glide phases of forward/uphill motion on a ski bottom. Side view 2-4 shows the OG curve profile of an individual denticle scale—the OG curve profile defined as a double curve resembling an 'S', formed by the union of a convex and concave line.

Figure 2B:
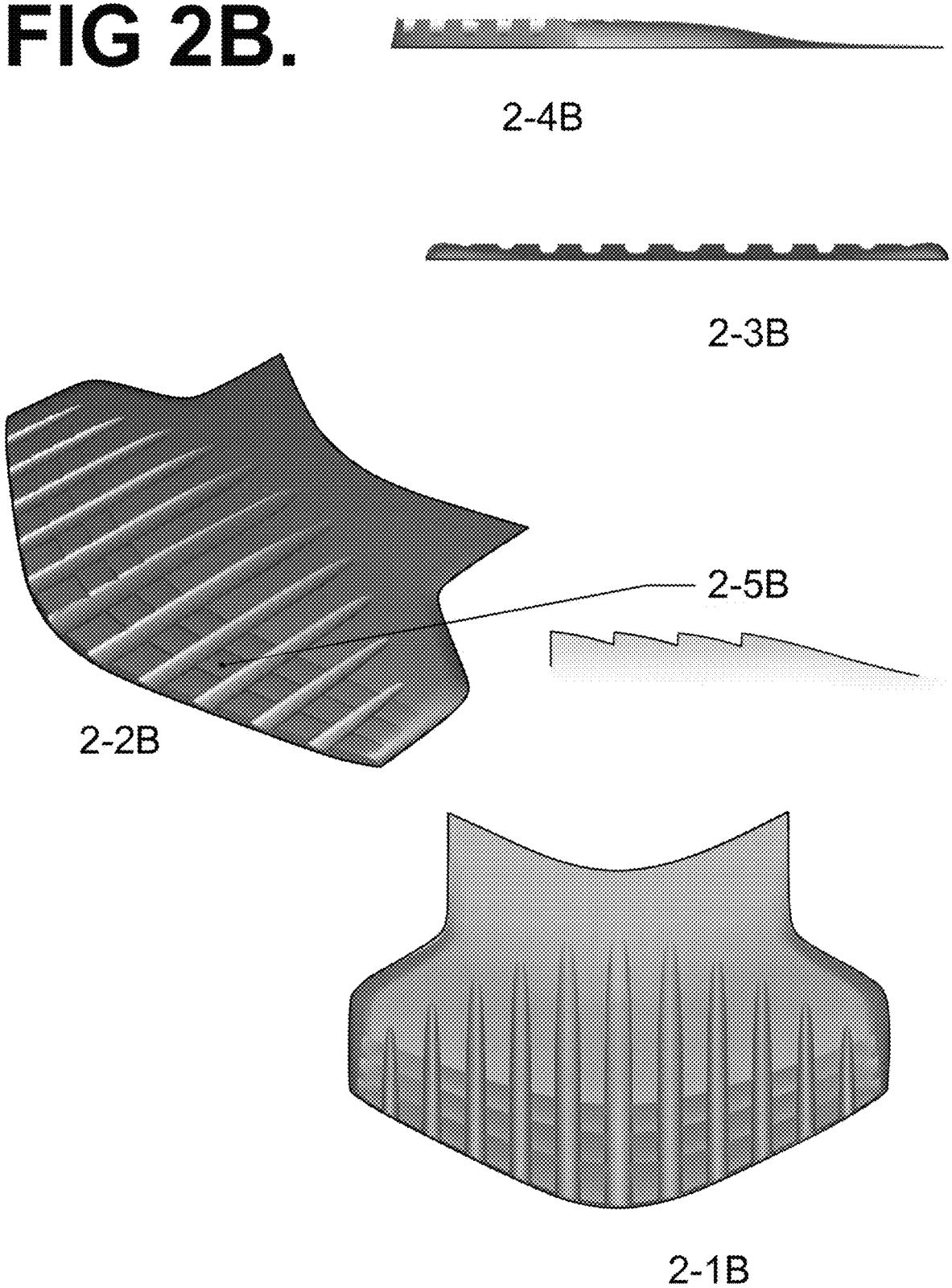
FIG. 2B shows multiple views (top 2-1B; perspective 2-2B; rear 2-3B; side 2-4B; section 2-5B) of an individual tractive scale design. Surface geometry is shown in detail in all views.

Referring to FIG. 2B, which is a further embodiment of the tractive individual scale shown in FIG. 2. A tractive individual denticle scale is shown in multiple views and a section view. Top view 2-1B shows the surface detail and perimeter of an individual denticle scale. Perspective view 2-2B shows the surface detail of indented grooved surfaces that are located on an individual denticle scale. Rear view 2-3B shows the raised surface of the individual denticle scale that is intersected with the snow surface during the tractive and glide phases of forward/uphill motion on a ski bottom. Side view 2-4B shows the OG curve profile of an individual denticle scale—the OG curve profile defined as a double curve resembling an 'S', formed by the union of a convex and concave line. Section view 2-5B illustrates the surface detail that is located on the horizontal raised surfaces between the grooves on the individual denticle scale.

Figure 3:
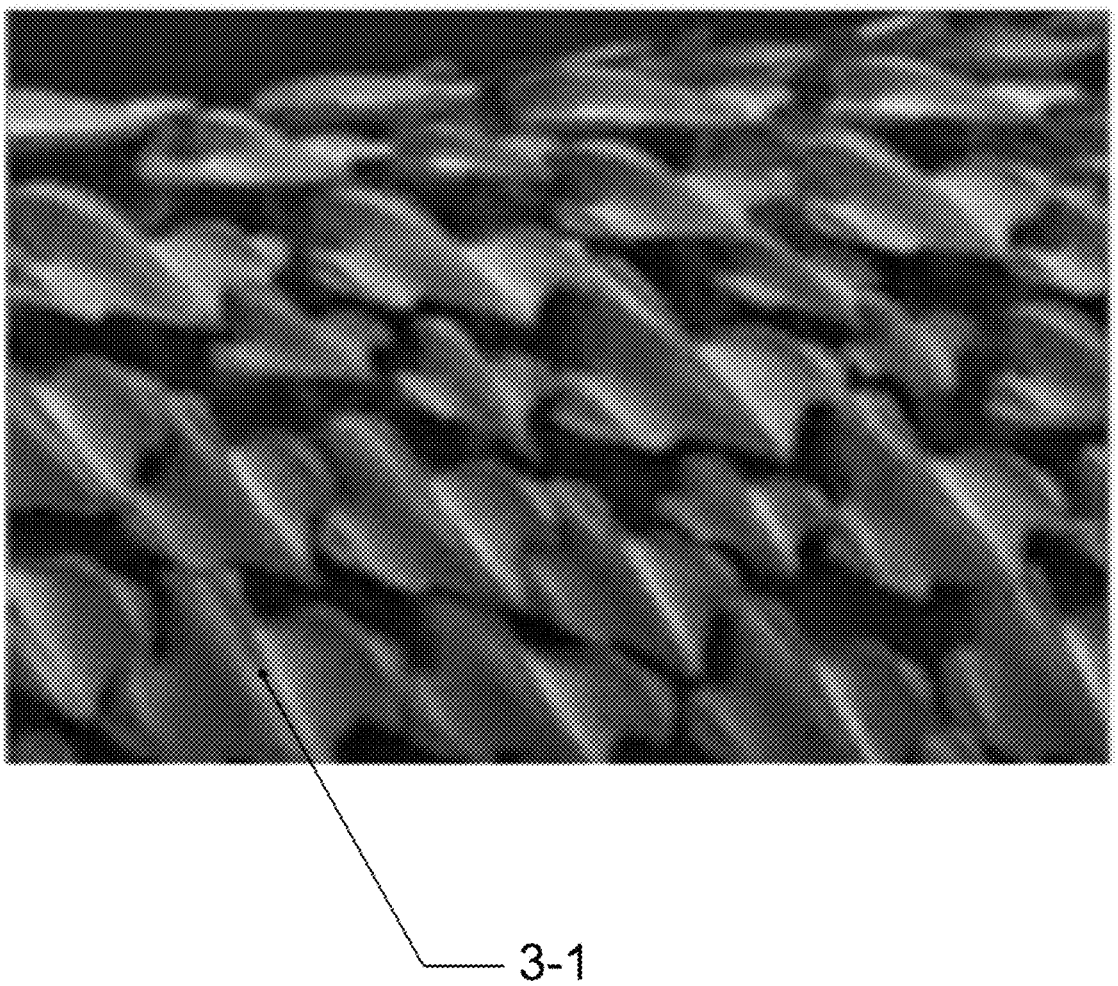
FIG. 3 is a perspective view of sharkskin surface detailing the surface geometry of the denticles that form an array.

Referring to FIG. 3, an array of sharkskin denticle scales is shown in perspective view. The sharkskin surface is an array, and is made up of individual scale denticles 3-1, which are complex in surface composition. An array of sharkskin denticle scales is known to have low frictional resistance to fluids passing over it's surface when moving dynamically. Additionally, sharkskin surface is known to be rough, or coarse to the touch when moving tail to head on a shark, and smooth to the touch when moving head to tail on a shark. FIG. 3 is an example of a complex array of surfaces found in nature (biomimicry) where there is low surface resistance dynamically in one direction, and higher surface resistance in the opposing direction.

Figure 5:
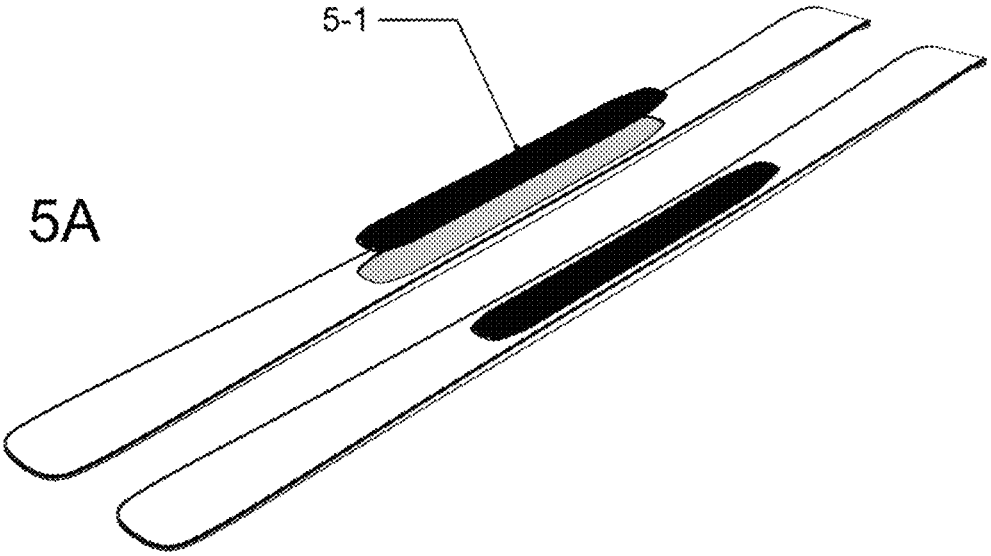
FIG. 5 shows a perspective view of a ski where the ski bottom has a denticle scale pattern. The denticle scale pattern encompasses the complete width of the bottom of the ski.
Figure 5:
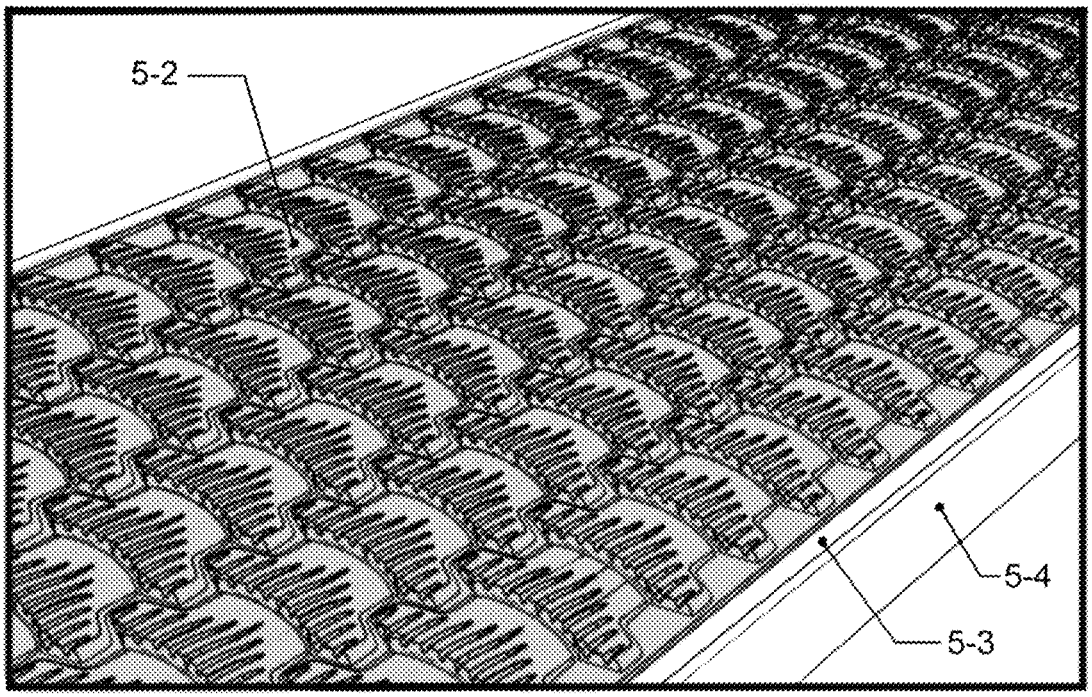

Referring to FIG. 5, a denticle scale array 5-2 is shown on a ski 5-4 bottom, where the denticle scale array is fixed to the ski 5-4 bottom. The denticle scale array pattern covers the ski bottom running surface that interfaces with the snow surface up to the intersection point of the ski edge 5-3. A removable denticle scale pattern 5-1 is also shown, illustrating that the denticle scale array pattern on the ski 5-4 bottom can be either a fixed configuration or a removable configuration.

Figure 6:
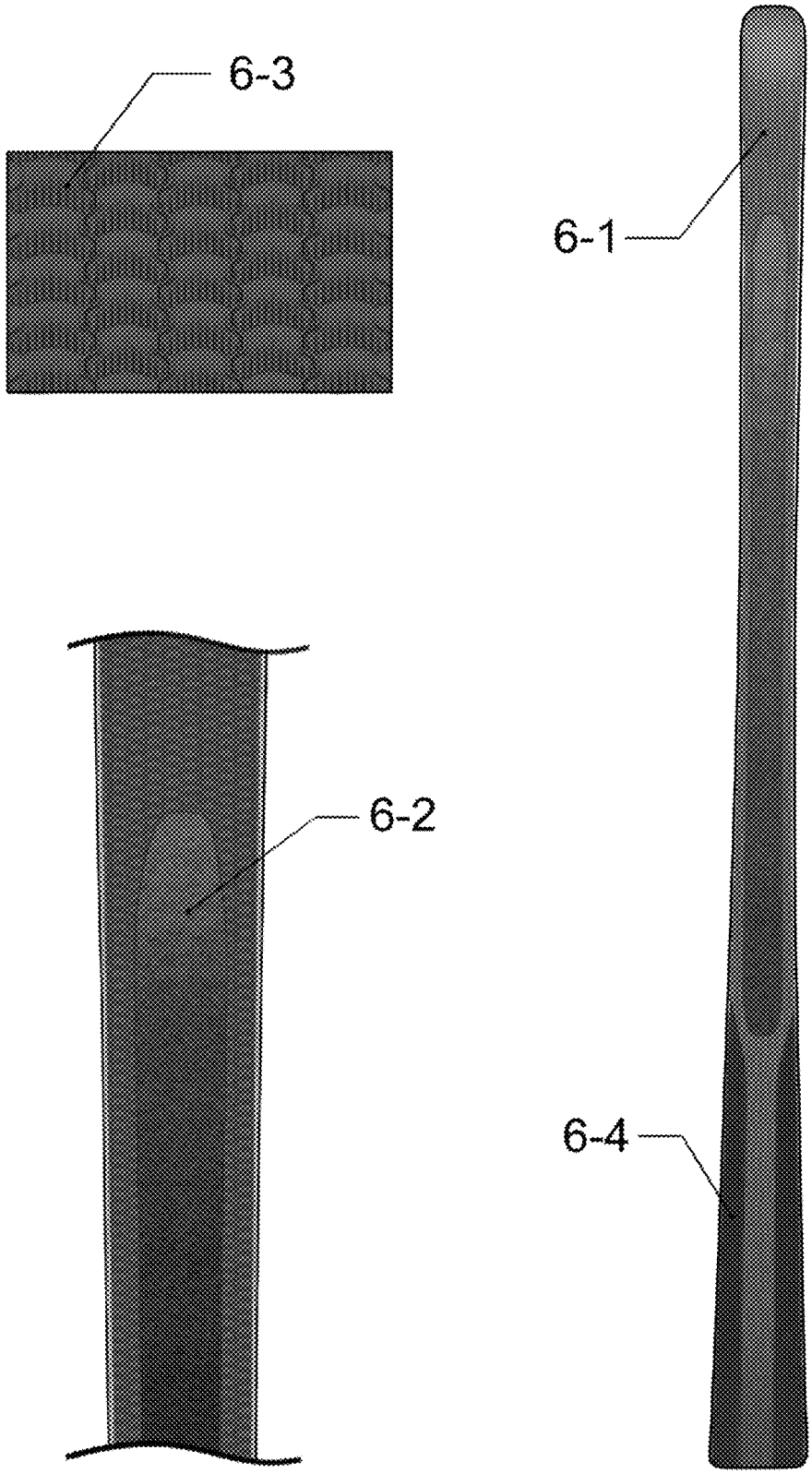
FIG. 6 is a view of a ski bottom with a removable climbing skin concept attached to the ski. The denticle scale pattern is described, as well as the location of a plush mohair/nylon fabric within the boundaries of the denticle scale pattern array.

Referring to FIG. 6, An embodiment of a tractive climbing skin 6-1 on a ski 6-4 is shown. The unique tractive pattern is shown in further detail 6-3, which describes the individual denticle scales and the denticle scale array that is molded by the optimal placement of the individual denticle scales. The mohair/nylon plush tractive surface 6-2 is shown as a central 'island' surrounded by the denticle scale array on the tractive climbing skin. Using a centrally located mohair/nylon plush on the tractive climbing skin, as well as a denticle scale array for the surrounding geometry enables a unique combination of tractive solutions for forward/uphill movement when installed on a ski bottom. This combination results in superior glide as a result of lower frictional resistance when moving forward/uphill, and superior traction as a result of increased snow contact when weighting the ski in a momentary static condition, herein described as 'kick'.

Figure 7:
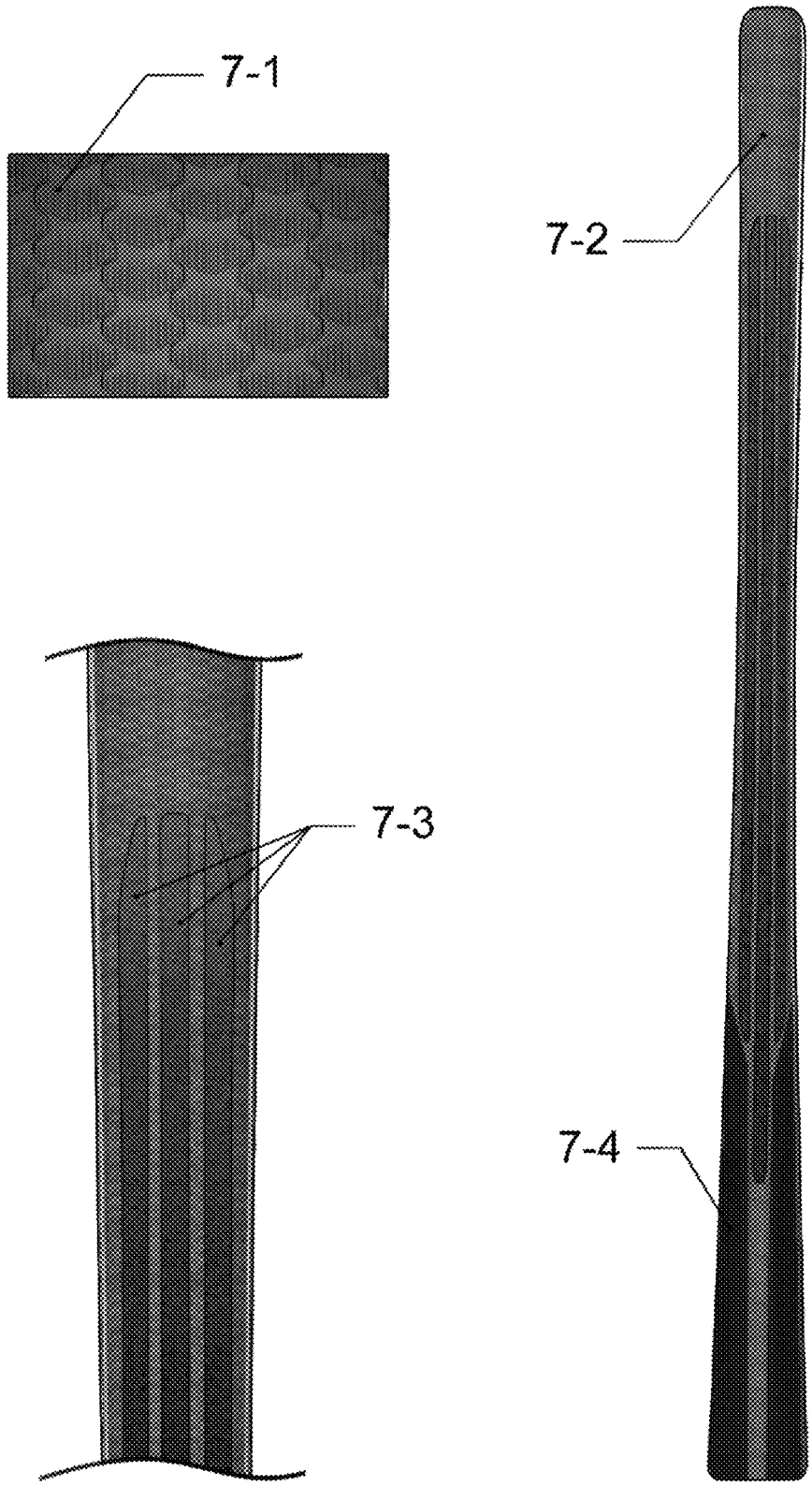
FIG. 7 is a view of a ski bottom with a removable climbing skin concept attached to the ski. The denticle scale pattern is described, as well as the location of a plush mohair/nylon fabric within the boundaries of the denticle scale pattern array.

Referring to FIG. 7, A further embodiment of a tractive climbing skin 7-2 on a ski 7-4 is shown. The unique tractive pattern is shown in further detail 7-1, which describes the individual denticle scales and the denticle scale array that is molded by the optimal placement of the individual denticle scales. The mohair/nylon plush tractive surface 7-3 is shown as a three central 'islands' surrounded by the denticle scale array on the tractive climbing skin. Using a centrally located mohair/nylon plush on the tractive climbing skin, as well as a denticle scale array for the surrounding geometry enables a unique combination of tractive solutions for forward/uphill movement when installed on a ski bottom. This combination results in superior glide as a result of lower frictional resistance when moving forward/uphill, and superior traction as a result of increased snow contact when weighting the ski in a momentary static condition, described as 'kick'.

Figure 8:
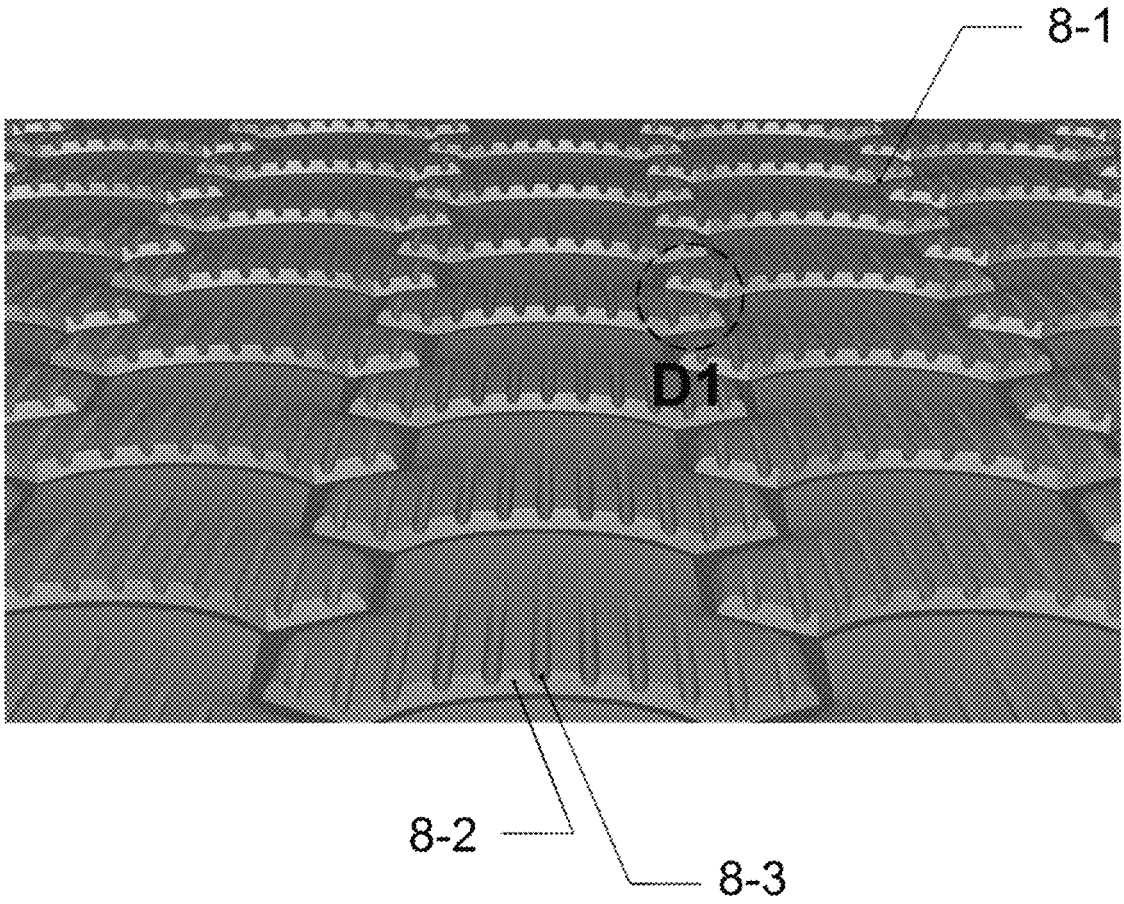
FIG. 8 is a perspective view that focuses on the rear portion of unique denticle scales in an array.

Referring to FIG. 8, a denticle scale array is shown in a rear perspective view. D1 shows the overlap of the rear portion of the denticle scales 8-1. The overlap is created by the optimal array pack placement of the individual denticle scales. The overlap increases the tractive ability of the denticle scale array through an increase in contact area of the snow. The rear vertical surface of the denticle scales 8-2 is shown, with grooves 8-3 that bisect the rear vertical surface in multiple locations horizontally on each individual denticle scale. When the denticle scale array similar to the one shown in FIG. 8 attached to the bottom of a ski is weighted vertically, the contact area is increased through the connection to the snow surface by the grooved surfaces 8-3 and the horizontal surfaces 22 of each individual denticle scale. The increase in contact area increases the tractive ability of the uphill/forward tractive solution on the ski bottom.

Figure 9:
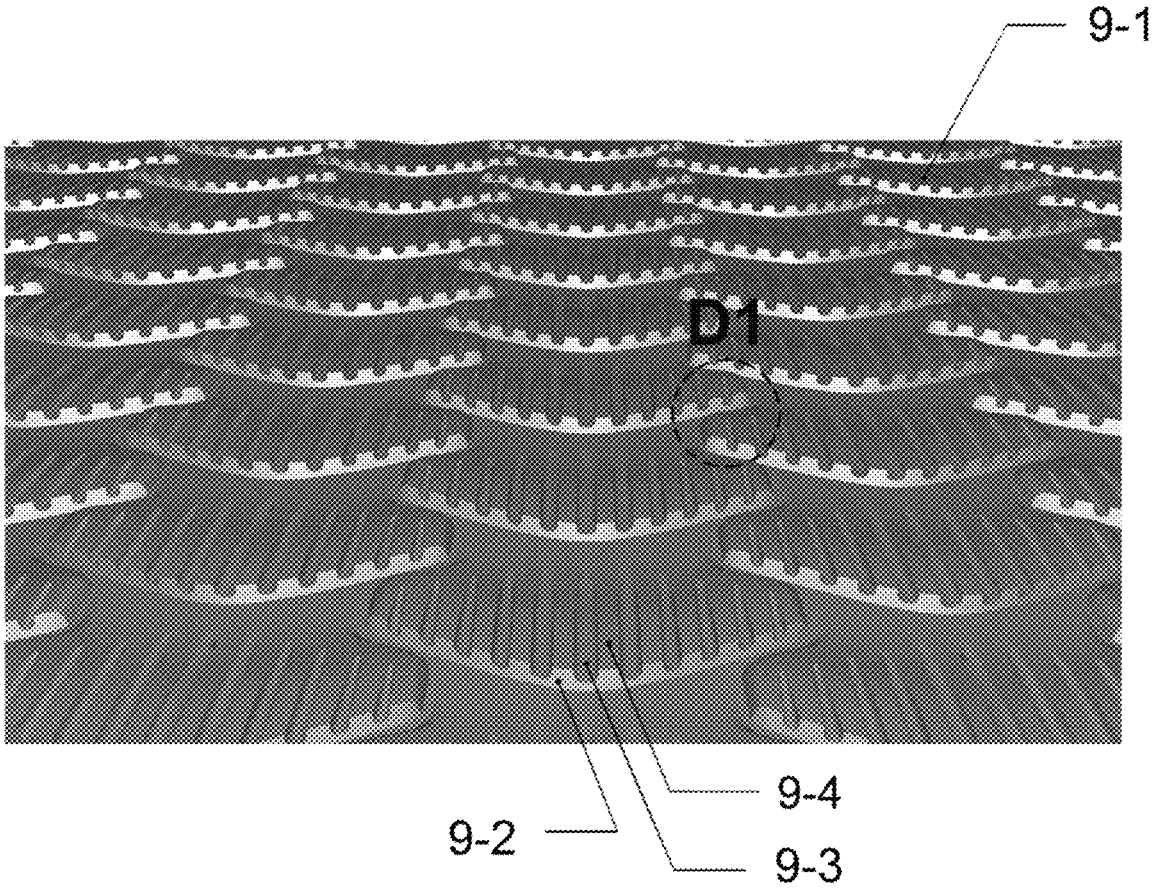
FIG. 9 is a perspective view that focuses on the rear portion of unique denticle scales in an array.

Referring to FIG. 9, an alternative denticle scale array is shown in a rear perspective view. D1 shows the overlap of the rear portion of the denticle scales 9-1. The overlap is created by the optimal array pack placement of the individual denticle scales. The overlap increases the tractive ability of the denticle scale array through an increase in contact area of the snow surface. The rear vertical surface of the denticle scales 9-2 is shown, with variable geometry grooves 9-3 that bisect the rear vertical surface in multiple locations horizontally on each individual denticle scale. When the denticle scale array similar to the one shown in FIG. 8, FIG. 9 are attached to the bottom of a ski that is weighted vertically, the contact area is increased through the connection to the snow surface by the grooved surfaces 9-3 and the horizontal surfaces 9-4 of each individual denticle scale. The increase in contact area increases the tractive ability of the uphill/forward tractive solution on the ski bottom resulting in a unique and novel solution.

The invention claimed is:

1. A denticle scale array comprising:

a plurality of denticle scales arranged in pattern and configured to be incorporated onto a ski base, wherein the plurality of denticle scales comprises:

at least a denticle scale and comprising:

a glide contact area configured to contact terrain when the ski base is unweighted and moving forward;

a kick contact area greater than the glide contact area and configured to contact the terrain when the ski base is weighted and not moving forward;

at least a longitudinal profile comprising an S-curve;

a curved trailing edge profile; and at least a longitudinal groove running parallel with the forward movement of the ski base.

2. The denticle scale array of claim 1, wherein the at least a denticle scale further comprises at least a longitudinal profile comprises a plurality of S-curves.

3. The denticle scale array of claim 1, wherein the at least a longitudinal groove extends only a portion of a length of the at least a denticle scale.

4. The denticle scale array of claim 1 manufactured by molding.

5. The denticle scale array of claim 1, wherein the at least a denticle scale comprises shark skin surface features.

6. The denticle scale array of claim 1, wherein the at least a denticle scale array is further configured to:

exhibit a first resistance when the ski base is moving forward over the terrain; and exhibit a second resistance, greater than the first resistance, when the ski base is moving backward over the terrain.

7. The denticle scale array of claim 1, wherein the denticle scale array is configured to be incorporated over only a portion of the ski base.

8. The denticle scale array of claim 7, wherein the portion of the ski base includes a portion of a tip of the ski base and a portion of a tail of the ski base.

9. The denticle scale array of claim 7, wherein the portion of the ski base includes circumscribes an island without denticle scales.

10. The denticle scale array of claim 9, wherein the island is configured to contain a tractive material.

11. A climbing skin comprising a denticle scale array, wherein the denticle scale array comprises:

a plurality of denticle scales arranged in pattern and configured to be incorporated onto a ski base, wherein the plurality of denticle scales comprises:

at least a denticle scale and comprising:

a glide contact area configured to contact terrain when the ski base is unweighted and moving forward;

a kick contact area greater than the glide contact area and configured to contact the terrain when the ski base is weighted and not moving forward;

at least a longitudinal profile comprising an S-curve;

a curved trailing edge profile; and at least a longitudinal groove running parallel with the forward movement of the ski base.

12. The climbing skin of claim 11, wherein the at least a denticle scale further comprises at least a longitudinal profile comprises a plurality of S-curves.

13. The climbing skin of claim 11, wherein the at least a longitudinal groove extends only a portion of a length of the at least a denticle scale.

14. The climbing skin of claim 11 manufactured by molding.

15. The climbing skin of claim 11, wherein the at least a denticle scale comprises shark skin surface features.

16. The climbing skin of claim 11, wherein the at least a denticle scale array is further configured to:

exhibit a first resistance when the ski base is moving forward over the terrain; and exhibit a second resistance, greater than the first resistance, when the ski base is moving backward over the terrain.

17. The climbing skin of claim 11, wherein the denticle scale array is configured to be incorporated over only a portion of the ski base.

18. The climbing skin of claim 17, wherein the portion of the ski base includes a portion of a tip of the ski base and a portion of a tail of the ski base.

19. The climbing skin of claim 17, wherein the portion of the ski base includes circumscribes an island without denticle scales.

20. The climbing skin of claim 19, wherein the island is configured to contain a tractive material.

* * * * *